US005400834A

United States Patent [19]

Lewyllie et al.

[11] Patent Number: 5,400,834

[45] Date of Patent: Mar. 28, 1995

[54] APPARATUS FOR SELECTIVELY MOVING WEFT FEEDERS BETWEEN A REST POSITION AND A FEED POSITION

[75] Inventors: Dirk Lewyllie, Wervik; Bernard Vancayzeele, Ieper; Geert Geerardyn, Nieuwkerke, all of Belgium

[73] Assignee: Picanol, N.V., Ieper, Belgium

[21] Appl. No.: 145,196

[22] Filed: Nov. 3, 1993

[30] Foreign Application Priority Data

Nov. 16, 1992 [BE] Belgium ..... 09200987

[51] Int. Cl.[6] ..... D03D 47/38

[52] U.S. Cl. ..... 139/453

[58] Field of Search ..... 74/526; 112/221; 139/453, 353, 450

[56] References Cited

U.S. PATENT DOCUMENTS

| | | | |
|---|---|---|---|
| 875,608 | 12/1907 | Parkes | 112/221 |
| 4,190,006 | 2/1980 | Mellor | 112/221 X |
| 4,326,566 | 4/1982 | Lampaert . | |
| 4,406,312 | 9/1983 | Egbers et al. | 139/453 |
| 4,781,226 | 11/1988 | Moeneclaey et al. . | |
| 4,964,443 | 10/1990 | Van Bogaert et al. . | |
| 5,165,454 | 11/1992 | Kanayama et al. | 139/353 |
| 5,172,735 | 12/1992 | Kleiner | 139/453 |

FOREIGN PATENT DOCUMENTS 0362089 4/1990 European Pat. Off. .

0478986 4/1992 European Pat. Off. .

*Primary Examiner*—Andrew M. Falik

*Attorney, Agent, or Firm*—Bacon & Thomas

[57] ABSTRACT

In an apparatus for selecting and feeding wefts to an insertion device of a weaving machine, the feeders are directly connected to eccentric drives which have an excursion corresponding at least to the paths covered by the feeders between their rest and feed positions, and each feeder is associated with a guide and arranged to compensate for transverse displacements of the eccentric drives which deviate from the reciprocating motions of the feeders. The feeders have an excursion corresponding to at least the distance between the rest and feed positions of the feeder, with each feeder together with a drive motor, the eccentric drive, and the guide forming a module to simplify matching of yarn feeders to the requirements of a specific fabric and exchange of units in case of a defect. Advantageously, the modules of neighboring feeders may be mounted in mirror-symmetric manner relative to a common plane in which all of the feeders are mounted. The drive motor is preferably connected to a control unit arranged to control the drive motor to position the feeder at a position intermediate between the rest and the feed positions and selected in such a manner that the weft is deflected as little as possible by the feeder when being inserted.

22 Claims, 4 Drawing Sheets

F7

APPARATUS FOR SELECTIVELY MOVING WEFT FEEDERS BETWEEN A REST POSITION AND A FEED POSITION

BACKGROUND OF THE INVENTION

1. Field of the Invention

The invention concerns an apparatus for selecting and feeding weft yarns to an insertion device of a weaving machine, in which at least one weft feeder is displaceable between a rest position and a feed position by means of an eccentric drive having its own drive motor.

2. Description of Related Art

An apparatus which selects and feeds weft yarns to an insertion device of a weaving machine, and which has at least one weft feeder for feeding a weft and guided in its longitudinal direction, is shown in European published patent application EP 0 362 089 A1. In this apparatus, the rod- or needle-shaped feeders are supported in longitudinally displaceable manner in two longitudinal guides and are acted upon by rockers having a first end which is stationary and a second end which engages the feeders between longitudinal guides. The rockers are moved by actuation rods, first ends of which engage a central portion of the rockers and the other ends of which are connected to an eccentric drive which includes a drive motor, in particular a stepping motor. The excursion of the eccentric drives is transformed by the rockers, as a result of which the feeders move over a distance between their rest and feed positions which is about twice the excursion.

In another apparatus, disclosed in European published patent application EP 0 478 986 A1, displaceable yarn feeders are affixed to a toothed belt on alternating sides from the rest to the feed position. The toothed belt runs around a reversing wheel and around a drive wheel which has been actuated by an electric motor into a reciprocating motion.

Other apparatus for selecting and feeding wefts to an insertion device of a weaving machine are described in U.S. Pat. Nos. 4,964,443 and 4,781,226. In the apparatus described in the two U.S. patents, the feeders are actuated from the central machine drive by the intermediary of transmission means.

SUMMARY OF THE INVENTION

It is a principal objective of the invention to provide an apparatus of the type described above, in which at least one weft feeder guided in its longitudinal direction is displaceable by means of an eccentric drive between a rest position and a feed position, and in which the feeder can operate at higher rates than prior feeders.

This objective is achieved by a feeder which is directly connected to the eccentric driving having an excursion corresponding at least to the distance between the rest and feed positions of the feeder, and by providing an improved guide for the feeder.

The apparatus of the invention offers the advantage that only comparatively slight masses need be moved to displace the feeder(s) between the rest and feed positions, resulting in higher operational rates for the feeder(s) and, consequently, high weaving rates. Another advantage is that the feeder(s) can be displaced in arbitrary sequence and at arbitrary times independently of the other machine parts.

In this simple design, a guide rotatable about an axis parallel to a shaft of the associated eccentric drive is provided for each feeder. As a result, compensation between the reciprocating feeder motion(s) and the transverse, deviating motions of the eccentric drive can be achieved, without necessitating an increase in the masses to be moved.

In an especially advantageous embodiment of the invention, each feeder together with a drive motor, its eccentric drive and its guide forms a module. This simplifies matching of the number of yarn feeders to the requirements of a specific fabric. Moreover, the module may be exchanged as a unit in case of defect.

In a further preferred embodiment of the invention, the feeders are mounted in a common plane. Especially advantageously, in this embodiment, the modules of neighboring feeders are mounted in mirror-symmetrical manner relative to the common feeder plane. As a result, a plurality of feeders can be arranged very compactly.

To reduce the stresses on wefts when they are being inserted, the drive motor is preferably connected to a control unit containing means for stopping the drive motor in a position intermediate between the rest and the feed position. This intermediate position is selected in such a manner that the weft is deflected as little as possible by the feeder when being inserted.

Further features and advantages of the invention are elucidated in the description below of the illustrative embodiments shown in the drawing.

DETAILED DESCRIPTION OF THE PREFERRED EMBODIMENTS

Figure 1:
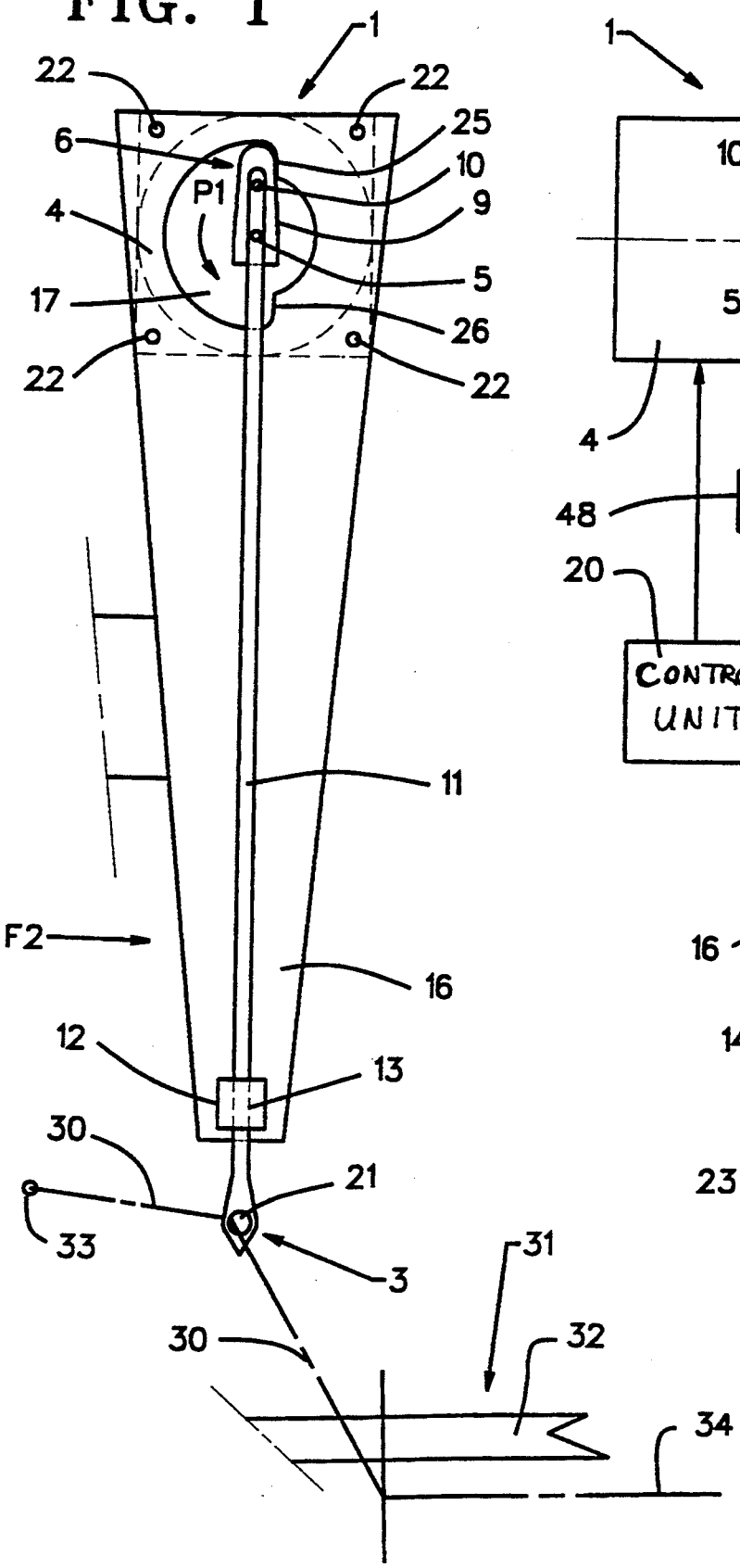
FIG. 1 is an elevated schematic view of an apparatus constructed in accordance with the principles of a preferred embodiment of the invention.
Figure 2:
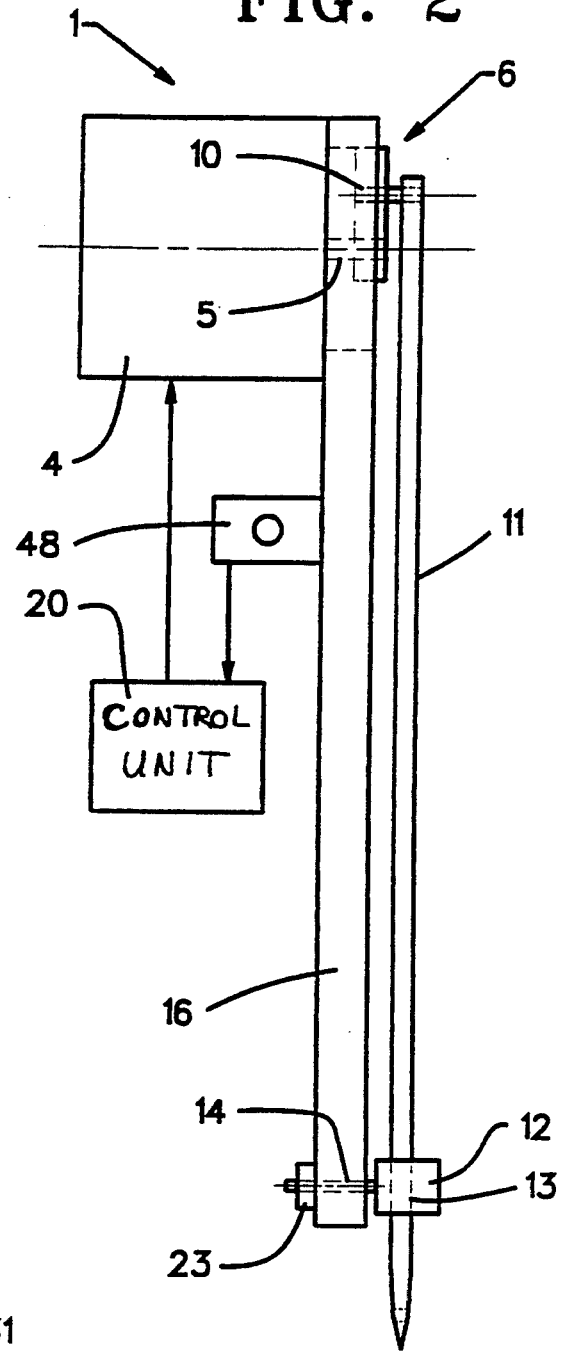
FIG. 2 is an elevation of the apparatus of FIG. 1 taken in the direction of arrow F2.

FIGS. 1 through 4 show a single module 1 of an apparatus for selecting and feeding wefts which includes a plurality of identical modules 1. Each module 1 contains a yarn feeder 3, one end of which includes an eye 21 for guiding a weft 30.

Each module 1 also contains a drive motor 4 for the yarn feeder 3. The drive motor 4 is directly connected through an eccentric drive 6 to the yarn guide 3, which is in the form of a round bar or needle 11. A crank 9 parallel to the yarn feeder 3 is irrotationally mounted to the shaft 5 of the drive motor 4, the shaft running transversely to the longitudinal axis of the yarn feeder. The crank 9 includes a crank pin 10 which supports the end of the yarn feeder 3 that is opposite the eye 21. The rod or needle 11 of the yarn feeder 3 passes through a longitudinal borehole 13 of a guide 12. This guide 12 is mounted as close as possible to the end of the yarn feeder 3 which includes the eye 21 and further is rotatable about a pin 14 parallel to the shaft 5.

Figure 3:
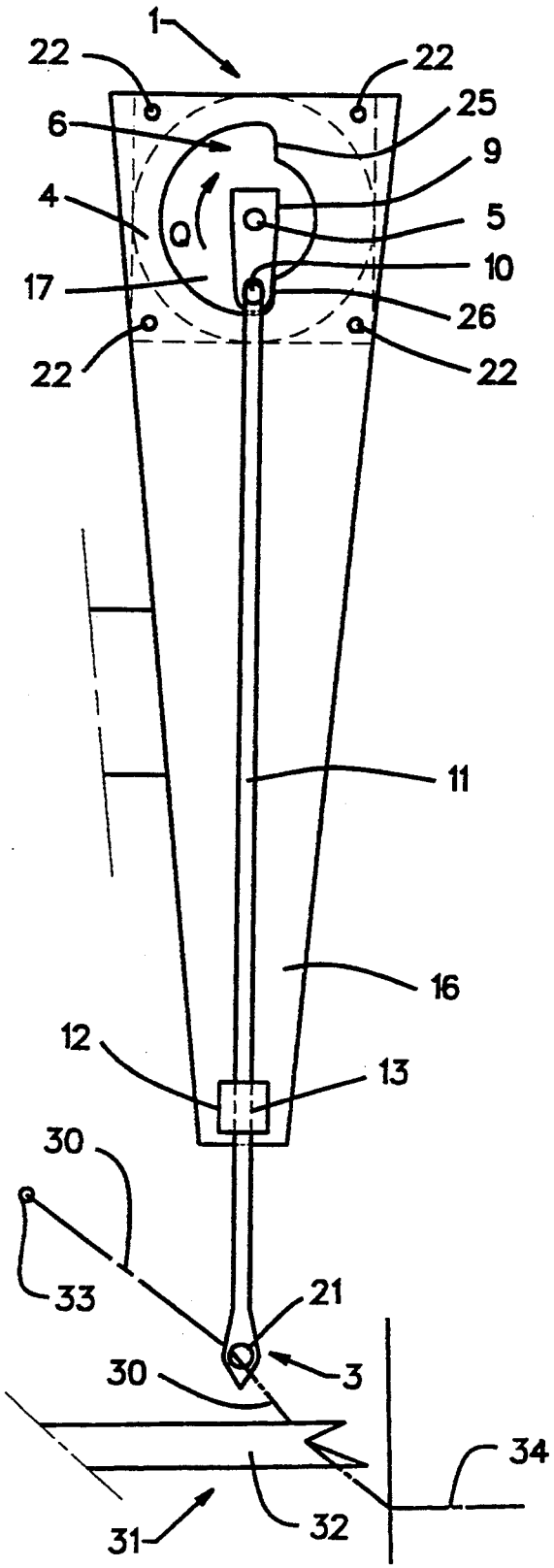
FIGS. 3 and 4 are elevations corresponding to that of FIG. 1 but showing feeder positions other than that shown in FIG. 1.
Figure 4:
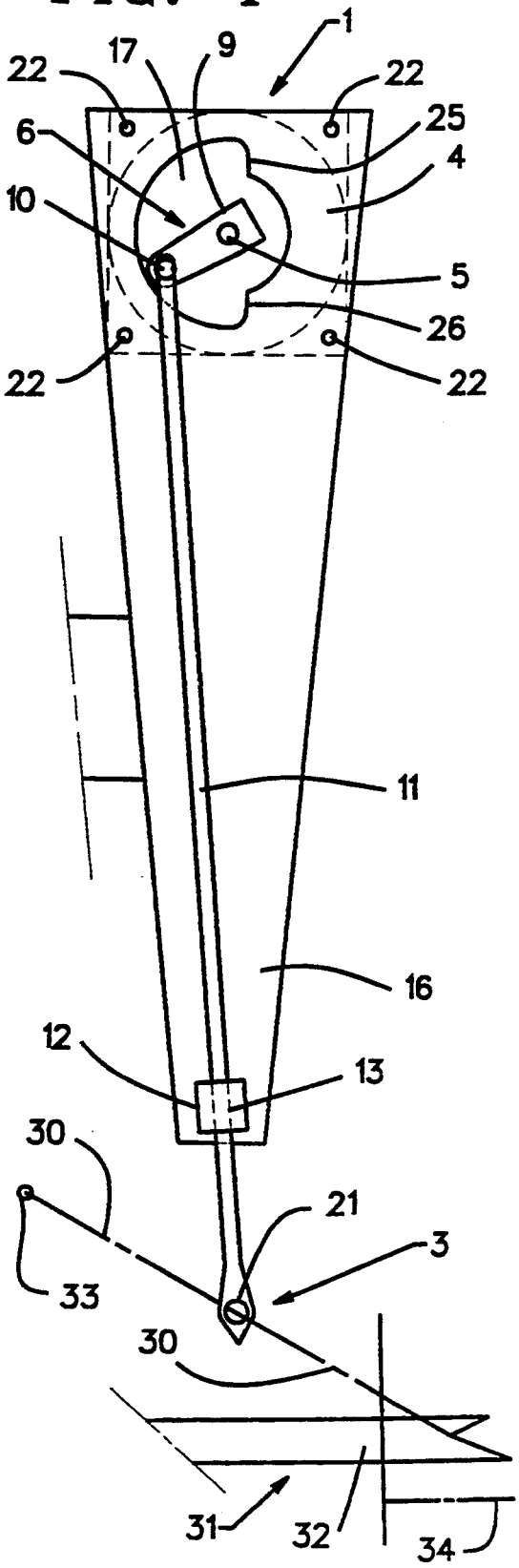

Each module 1 includes a support plate 16. The drive motor 4 is affixed to a back side of the plate 16 by a suitable affixing means such as screws 22. In the area of the eccentric drive 6, plate 16 includes a clearance 17. The yarn feeder 3 and its guide 12 are located on that side of the plate 16 which is opposite the drive motor 4. By its pin 14, the guide 12 passes through the plate 16 and is secured in place on the opposite side by a securing element such as a clip 23. As shown by FIGS. 1, 3 and 4, the base surface of the plate 16 is trapezoidal, tapering from the area of the drive motor 4 toward the area of the guide 12.

The masses of the parts to be moved by the drive motor 4, namely of the crank 9 and of the yarn feeder 3 and the guide 12 are comparatively slight, as a result of which only commensurately low inertias need be overcome to move the yarn feeder 3. Consequently, higher operational rates and/or the use of relatively low-power drive motors 4 are made possible.

The maximum angle of the motor-shaft rotation is bounded by stops 25, 26. In the illustrated embodiment, the stops are made up of projections 25, 26 of the clearance 17, which limit the maximum angle of rotation of the crank 9 and hence also of the shaft 5 of the drive motor 4. The projections 25, 26 are arranged in such a way that for the rest and feed positions, shown in FIGS. 1 and 3, respectively, the crank 9 and the rod of the yarn feeder 3 are aligned, i.e., the shaft 5 and the crank pin 10 are in a plane passing through the axis of the rod or needle 11.

In a variation of the above-described embodiment, adjustable stops are provided, for example in the form of adjusting screws mounted on the plate 16 and limiting the angle of rotation of the crank 9.

The drive motors 4 of the particular modules 1 are hooked up to an electronic control unit 20 for determining when and how, i.e., at what speed, the yarn feeders 3 are moved from the rest position (FIG. 1) toward the feed position (FIG. 3) and, where called for, also to an intermediate position (FIG. 4). The control unit 20 is able to move the yarn feeder 3 at any time and regardless of the positions of other machine parts such as a reed-batten drive, harness drive, or other drives, into the desired position. As a result, the displacement of the yarn feeder 3 can be selected, for instance, in relation to the kind of weft, or the weft insertion may be cancelled, or the yarn feeder 3 may be moved during beat-up or weaving-machine shutdown into an arbitrary position.

In a preferred embodiment of the invention, the drive motors 4 are stepping motors fed by the control unit 20 with a pulse sequence or a number of pulses suited for the desired motion. This pulse sequence may be selected in such a manner that, for the rest position, the crank 9 is forced against the stop 25 and, for the feed position, against the stop 26, as a result of which two stable positions are provided for the yarn feeder 3. Preferably, however, the pulse sequence is such that the crank 9 does not rest against the stop 25 or 26 when in its end positions. This feature can be achieved by appropriately selecting the number of steps through which the drive motor is actuated. The yarn feeder 3 can be kept in an adjustable rest or feed position by applying a so-called latching current to the drive motor 4. This latching current is selected to be in such a direction that positioning of the yarn feeder 3 remains unaffected by weaving-machine vibrations or by forces applied to it by the wefts. When the crank 9 and the rod or needle 11 of the yarn feeder 3 are at least approximately aligned in the rest and/or feed positions, forces applied by a weft 30 on the yarn feeder 3 are not transmitted to the crank 9, and therefore only a relatively low retaining current is required.

Because the eccentric drive 6 provides only a relatively small component of motion in the longitudinal direction of the yarn feeder 3 at the beginning of its displacement out of the rest position, i.e., in the direction of the arrow P1 of FIG. 1, and also out of the feed position, i.e., in the direction of the arrow Q in FIG. 3, the start of the motion of feeder 3 is comparatively smooth, as a result of which the wefts 30 are not stressed and the danger of rupturing them is reduced. To enhance this effect, the control unit 20 may feed the pulse sequence in variable frequencies to the drive motor 4, so that drive motor 4 always starts smoothly.

When the yarn feeder 3 is in its rest position, then after a given time or illustratively after a specified number of beat-ups of the batten, the crank 9 may be made to rest against the stop 25, as a result of which a reference position of the motor shaft 5 is set for the control unit 20. However, such a reference position also can be implemented using a detector such as a proximity switch.

In another preferred embodiment of the invention, the shaft 5 of the drive motor 4 is fitted with an angle sensor connected to the control unit 20. In that case, the control unit 20 is able to actuate the drive motor 4, which need not be a stepping motor, until the pre-determined angular position is reached. Also, the drive motor 4 may be actuated at such a variable angular speed that startup always takes place at a low speed. For that purpose, the control unit 20 may feed the drive motor 4 with a variable-frequency current.

In the rest position (FIG. 1), the yarn feeder 3 deflects a weft extending between a stationary yarn feeder, for example a stationary eye 33, and a shed 34 such that it is located outside the range of displacement of an insertion device 31, in particular a gripper 32, in the manner schematically indicated in FIG. 1. In the feed position (FIG. 3), the yarn feeder 3 has been displaced such that the weft 30 now runs within a zone where it is seized by the insertion device 31, for instance the gripper 32. Once the weft 30 has been seized by the insertion device 31, the yarn feeder 3 can be returned to its rest position.

In one design shown in FIG. 4, however, the yarn feeder 3 is moved into an intermediate position during weft insertion. In the intermediate position, the weft 30 in the vicinity of the eye 21 of the yarn feeder 3 is deflected as little as possible, decreasing friction in the vicinity of the eye 21 and hence also the danger of weft rupture. Moreover, the yarn feeder 3 may also be shifted with a constant motion in such a way that the friction in the eye 21 is minimized, by enabling the yarn feeder 3 to change its position. Again, this constant shifting can be implemented by suitably designing the control unit 20. The provision for movement into the intermediate position also is advantageous in the situation where, during the next weft insertion, the same weft needs to be reinserted. In that case, the yarn feed 3 need only cover a shortened path to its feed position.

In case of weft rupture, the weft feeder 3 appropriately is moved into a position in which threading of the weft is easy. For that purpose, a switch 48 is associated with each module 1 and is connected to the control unit 20. By actuating the switch 48, a signal is fed to the control unit 20 which then moves the associated yarn feeder 3 into the threading position by appropriately rotating the drive motor 4. In the case where drive motor 4 is a stepping motor, the control unit 20 supplies a corresponding latching current for the threading position. By actuating the switch 48 of the active yarn feeder 3 again, the feeder is returned to its initial position.

Figure 5:
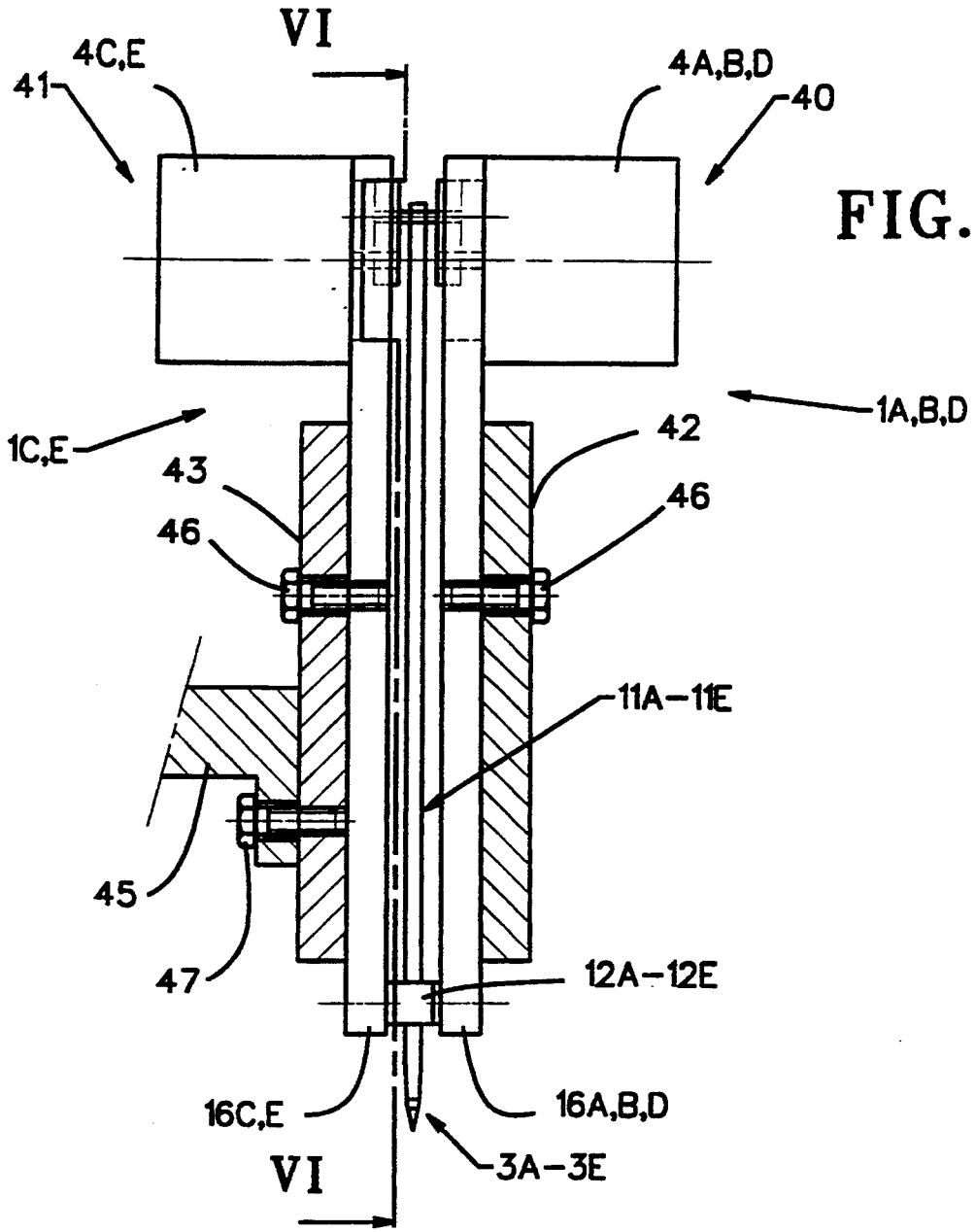
FIG. 5 is a partly sectional view similar to that of FIG. 2 but showing a mirror-symmetrical arrangement of modules according to a further preferred embodiment of the invention.
Figure 7:
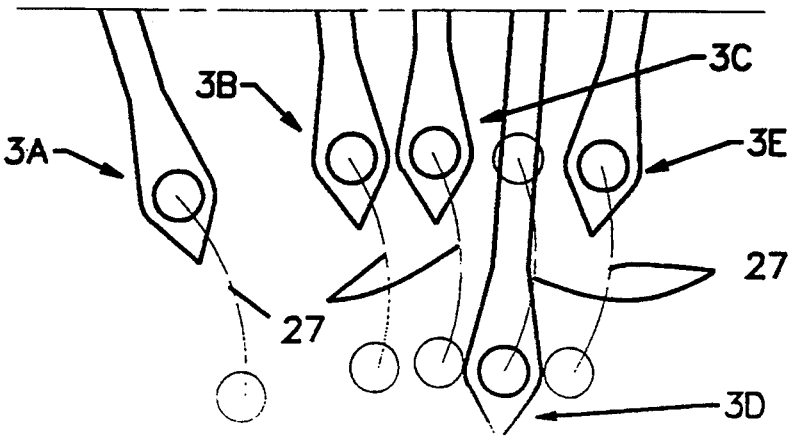
FIG. 7 shows the detail F7 of FIG. 6 on an enlarged scale.
Figure 6:
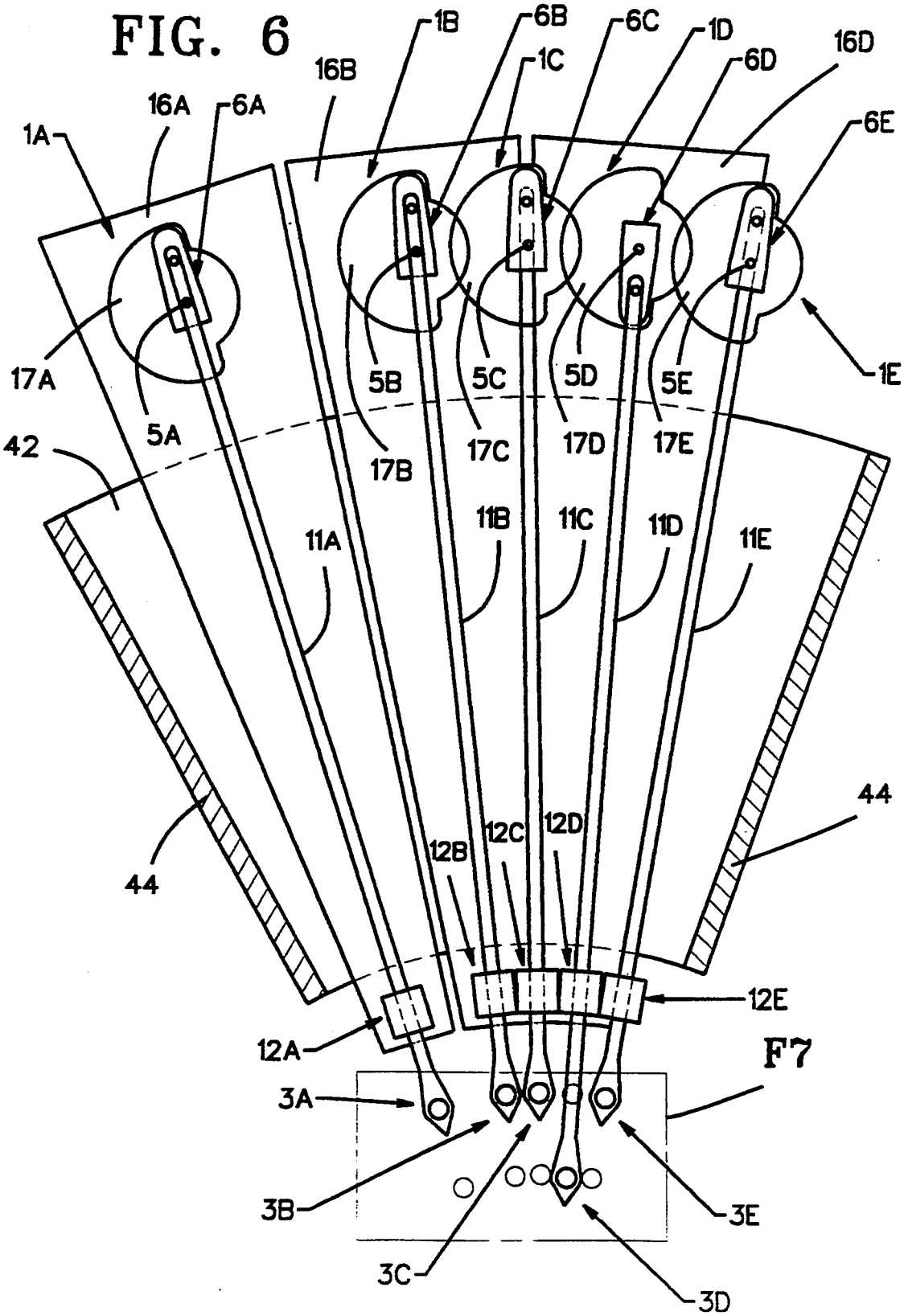
FIG. 6 is a sectional view taken along line VI—VI of FIG. 5.

As mentioned above, the preferred apparatus for selecting and feeding wefts includes a plurality of modules such as shown in FIGS. 5 through 7. For clarity, only five modules 1A through 1E are shown, although those skilled in the art will appreciate that, in practice, the number of modules may be substantially higher. Each particular module 1A through 1E is designed as in the above described embodiments, i.e., each module includes a drive motor 4A through 4E, and an eccentric drive for a yarn feeder 3A through 3E which is always guided by a rod or needle 11A through 11 in a guide 12A through 12E. These components are affixed to plates 16A through 16E in the manner already discussed in relation to FIGS. 1 through 4. The yarn feeders 3A through 3E are located in a common plane. In order to mount the individual yarn feeders 3A through 3E as tightly through 4E, and an eccentric drive for a yarn feeder 3A through 3E which is always guided by a rod or needle 11A through 11E in a guide 12A through 12E. These components are affixed to plates 16A through 16E in the manner already discussed in relation to FIGS. 1 through 4. The yarn feeders 3A through 3E are located in a common plane. In order to mount the individual yarn feeders 3A through 3E as tightly against each other as possible, the modules 1A through 1E are arrayed in mirror-symmetrical manner relative to the common plane of the yarn feeders 3A through 3E in two rows 40, 41, and are mutually offset. The common plane may be flat, but it also may be spatially curved (convex). The plates 16A through 16E are mounted between two holding plates 42, 43 to which they are also affixed by screws 46. The plates 42, 43 are connected to each other by crossbars 44 (FIG. 6). The plate 43 is affixed by screws 47 to the machine frame 45.

In this preferred embodiment, as shown in FIG. 7, the yarn feeders 3A through 3E move along an arcuate path 27 between their rest and feed positions. To assure that the yarn feeders 3A through 3E do not hamper one another in spite of their tight sequence, the arcuate displacements 27 of all yarn feeders 3A through 3E are made to be mutually parallel. For that purpose, the direction of rotation of the drive motors 4C, 4E mounted on one side is opposite the direction of rotation of the drive motors 4*a*, 4B, 4D mounted on the other side. Accordingly, the clearances 17A, 17B, 17D also are mirror-symmetrical with the opposite clearances 17C, 17E. Advantageously, the same plates 16 may be used, with just the arrangement of the drive motors 4 and of the longitudinal guides 12 being interchanged on the base surfaces of the plates 16.

The individual modules 1A through 1C affixed to the plates 42, 43 can be arrayed so as to be in various relative positions. Furthermore, the plates 42, 43 can be aligned in relation to the machine frame 45 and be mounted in a commonly aligned position with respect to the frame. Because the apparatus is made up of a plurality of individual modules, it may be rapidly and simply enlarged or made smaller as called for by adding or removing modules 1. If defective, a particular module can easily be exchanged as a unit. Also, because the drive motors 4 are mounted on the outside even for the mutually opposite design of FIG. 5, they are directly accessible and therefore can also be easily exchanged if defective.

As shown by FIGS. 6 and 7, the yarn feeders 3A through 3E when in the feed position are adjacent to one another, and the individual modules can be aligned such that all yarn feeders 3A through 3E assume feed positions essentially located on the same axis or even in the same point.

The motion of the yarn feeders 3 being independent of the motions of other weaving-machine drives, the advantage follows that, for instance in case of yarn rupture, the particular yarn feeder 3 can be moved again into the feed position without the need to synchronize this motion with other machine drives, i.e., without having to move other machine drives forward or back. Even more advantageously, the movable parts are light, and accordingly high frequencies and therefore high weaving-machine speeds are feasible.

Another advantage obtained by the suitable control of the drive motors 4 as described above is that it is possible to change the rest positions of the yarn feeders 3 without mechanical adjustments. A corresponding adjustment can be implemented by the control unit 20 which is for example provided with an input unit.

The illustrated embodiments provide yarn eyes 21 for the yarn feeders 3. In another embodiment, the yarn feeders 3 are fitted with yarn clamps such as are known in the art.

In a variational embodiment, the guides 12 of the yarn feeders 3 are held by elastic rubber supports, as a result of which the pin 14 is eliminated. In another variation, the yarn feeders 3 are elastically supported in the transverse direction.

Furthermore, it is possible to displace the yarn feeders 3 rectilinearly between the rest and feed positions by using other means to compensate the transverse displacement of the eccentric drive in relation to the reciprocating motion of the yarn feeders 3. Illustratively, this can be implemented by forming the yarn feeders 3 each of two parts joined by a link of which the axis of rotation is parallel to the motor shaft 5.

Having thus described preferred embodiments of the invention and variations and modifications thereof in sufficient detail to enable those skilled in the art to make and use the invention based on the above description and accompanying drawings, it is nevertheless intended that the invention not be limited by the description or illustrations, but rather that it be defined solely by the appended claims.

We claim:

1. An apparatus comprising means for selecting and feeding weft yarns to an insertion device of a weaving machine including at least one weft feeder for feeding a weft yarn to the insertion device and means including an individual eccentric drive and an individual drive motor for selectively moving the weft feeder between a rest position and a feed position, wherein the feeder is directly connected to the eccentric drive, wherein an excursion of the eccentric drive corresponds at least to a path of the feeder between its rest and feed positions, and further comprising means for guiding the feeder between the rest and feed positions of the feeder.

2. Apparatus as claimed in claim 1, wherein the guide means includes means for compensating transverse displacements of the eccentric drive which deviate from a to-and-fro motion of the feeder between its rest and feed positions.

3. Apparatus as claimed in claim 2, further comprising a plurality of said feeders and wherein said guide means includes a guide rotatable about a pin parallel to a shaft of a respective said eccentric drive for each of said feeders.

4. Apparatus as claimed in claim 3, wherein each feeder together with a respective drive motor, eccentric drive, and guide forms one module.

5. Apparatus as claimed in claim 4, wherein each module comprises a plate to one side of which is affixed the respective drive motor and to the other side of which are arranged the respective feeder and guide.

6. Apparatus as claimed in claim 5, wherein the plates comprise means including stops for defining the feed positions of the eccentric drives.

7. Apparatus as claimed in claim 5, wherein the plates comprise means including stops for defining the rest positions of the eccentric drives.

8. Apparatus as claimed in claim 1, further comprising means for detecting angular positions of the drive motor.

9. Apparatus as claimed in claim 8, further comprising means for setting angular positions of the drive motor.

10. Apparatus as claimed in claim 1, wherein the eccentric drive is a crank drive having a crank mounted on a shaft of the drive motor, said crank comprising a crank pin which supports the feeder.

11. Apparatus as claimed in claim 10, further comprising means including stops for limiting movement of the crank.

12. Apparatus as claimed in claim 1, wherein each feeder together with a respective drive motor, eccentric drive, and guide forms one module and wherein the feeders of several modules are mounted in a common plane.

13. Apparatus as claimed in claim 12, wherein the modules of adjacent feeders are mounted mirror-symmetrically relative to the common plane.

14. Apparatus as claimed in claim 13, wherein the drive motors of the modules mounted mirror-symmetrically have mutually opposite directions of rotation.

15. Apparatus as claimed in claim 1, wherein the drive motor is connected to means including a control unit for controlling ON and OFF states and directions of rotation of the drive motor.

16. Apparatus as claimed in claim 15, wherein the control unit includes means for controlling angular speeds of the drive motor.

17. Apparatus as claimed in claim 15, wherein the control unit includes means for stopping the drive motor in an intermediate position between the rest and feed positions.

18. Apparatus as claimed in claim 15, wherein the drive motor is a stepping motor and the control unit includes means for feeding predetermined pulse frequencies to the drive motor.

19. Apparatus as claimed in claim 18, wherein the control unit includes means for varying a pulse repetition rate of the pulse sequences fed to the drive motor.

20. Apparatus as claimed in claims 15, further comprising means included a switch for, upon actuation, causing the feeder to be moved into a threading position.

21. An apparatus comprising means for selecting and feeding weft yarns to an insertion device of a weaving machine having means including at least one weft feeder for feeding a weft yarn to the insertion device and means including a drive motor for moving the weft feeder between a rest position and a feed position, the improvement wherein the drive motor is connected to means including a control unit for returning the weft feeder from said position to an intermediate position between the feed position and the rest position while the weft is being guided by the weft feeder during insertion of the weft into the weaving machine.

22. Apparatus as claimed in claim 21, wherein the control unit further includes means for constantly adjusting the drive motor and the feeder to match changes in a direction of advance of the weft.

* * * * *